United States Patent [19]

Horvath et al.

[11] Patent Number: 4,589,131

[45] Date of Patent: May 13, 1986

[54] VOICED/UNVOICED DECISION USING SEQUENTIAL DECISIONS

[75] Inventors: Stephan Horvath; Yung-Shain Wu, both of Zürich, Switzerland

[73] Assignee: Gretag Aktiengesellschaft, Regensdorf, Switzerland

[21] Appl. No.: 421,883

[22] Filed: Sep. 23, 1982

[30] Foreign Application Priority Data

Sep. 24, 1981 [CH] Switzerland ..... 6167/81

[51] Int. Cl.[4] ..... G10L 1/00

[52] U.S. Cl. ..... 381/38

[58] Field of Search ..... 381/29–48

[56] References Cited

U.S. PATENT DOCUMENTS

| | | | |
|---|---|---|---|
| 2,908,761 | 10/1959 | Raisbeck | 381/38 |
| 3,083,266 | 3/1963 | Mathews et al. | 381/38 |
| 3,102,928 | 9/1963 | Schroeder | 381/38 |
| 4,004,096 | 1/1977 | Bauer et al. | 381/49 |
| 4,074,069 | 2/1978 | Tokura et al. | 381/38 |
| 4,281,218 | 7/1981 | Chuang et al. . | |

OTHER PUBLICATIONS

B. S. Atal and L. R. Rabiner, "A Pattern Recognition Approach to Voiced-Unvoiced-Silence Classification with Applications to Speech Recognition", *IEEE Transactions on Acoustics, Speech, and Signal Processing,* vol. ASSP-24, No. 3, pp. 201-212, Jun. 1976.

L. R. Rabiner, "Application of an LPC Distance Measure to the Voiced-Unvoiced-Silence Detection Problem", *IEEE Transactions on Acoustics, Speech, and Signal Processing,* vol. ASSP-25, No. 4, pp. 338-343, Aug. 1977.

Y. Yatsuzuka and T. Ichikawa, "A Speech Detection System", *Proceedings of the Fourth International Joint Conference on Pattern Recognition,* pp. 1000-1002, Nov. 1978.

*Primary Examiner*—E. S. Matt Kemeny

*Attorney, Agent, or Firm*—Burns, Doane, Swecker & Mathis

[57] ABSTRACT

Speech signal is decided voiced or unvoiced by a sequence of unilateral decisions: a first test decides "unvoiced" if standardized energy $E_S$ is below a threshold, or "ambiguous" if above the threshold whereby a second test decides "unvoiced" if the number of zero crossings ZC is above a threshold, and ambiguous if below the threshold. Up to six criteria may be so tested as ambiguous before a "voiced" decision is made.

33 Claims, 4 Drawing Figures

80
1
2
3
Filter
A/D
$s_n$
4
Vocal Parameter Calculator
$k_j, a_j$
G
Buffer
5
13
12
Trans.
Energ.
Invers. Filter
6
$e_n$
10
7
60
Autocorrel.
8
AKF
V/UV-Det.
Pitch.
9
11
p, $k_j$
G
Encoder
14
70
ANALYSIS
SYNTHESIS
Decoder
15
p
G
$k_j$
16
P/N Gen.
17
Vocal Model Filter
18
Filter
D/A
21
20
19

Modem
90
Code
Decode
70
71
Main
Processor
50
Secendary
Processor
60
I/O
80
81
1
21

VOICED/UNVOICED DECISION USING SEQUENTIAL DECISIONS

BACKGROUND OF THE INVENTION

The present invention relates to a linear prediction process, and corresponding apparatus, for reducing the redundance in the digital processing of speech. It is particularly directed to a speech processing system in which the speech signal is analysed to determine parameters relating to a model speech filter, pitch and volume.

Speech processing systems of this type, so-called LPC vocoders, afford a substantial reduction in redundance in the digital transmission of voice signals. They are becoming increasingly popular and are the subject of numerous publications, representative examples of which include:

B. S. Atal and S. L. Hanauer, Journal Acoust. Soc. A., 50, pp. 637–655, 1971;

R. W. Schafer and L. R. Rabiner, Proc. IEEE, Vol. 63, No. 4, pp. 662–667, 1975;

L. R. Rabiner et al., Trans. Acoustics, Speech and Signal Proc., Vol. 24, No. 5, pp. 399–418, 1976;

B. Gold. IEEE Vol. 65, No. 12, pp. 1636–1658, 1977;

A. Kurematsu et al., Proc. IEEE, ICASSP, Washington 1979, pp. 69–72;

S. Horwath, "LPC-Vocoders, State of Development and Outlook", Collected Volume of Symposium Papers "War in the Ether", No. XVII, Bern 1978;

U.S. Pat. Nos.: 3,624,302—3,361,520—3,909,5-33—4,230,905.

Presently known and available LPC vocoders do not operate in a fully satisfactory manner. Even though the speech that is synthesized after analysis is in most cases relatively comprehensible, it is distorted and sounds artificial. A principle cause of this condition, among others, is the difficulty in deciding with adequate security whether a voiced or unvoiced speech section is present. Further causes are the inadequate determination of the pitch period and the inaccurate determination of the sound forming filter parameters.

The present invention is primarily concerned with the first of these difficulties and has as its object the improvement of a digital speech synthesizing process and system of the previously described type, to provide a correct and secure voiced/unvoiced decision and thus an improvement in the quality of synthesized speech.

A series of decision criteria are used for the voiced-/unvoiced classification and are applied individually or partly in combination. Conventional criteria include, for example, the energy of the speech signal, the number of zero transitions of the signal within a given period of time, the standardized residual error energy, i.e. the ratio of the energy of the prediction error signal to that of the speech signal, and the magnitude.of the second maximum of the autocorrelation function of the speech signal or of the prediction error signal. It is also customary to effect a transverse comparison with one or several adjacent speech sections. A clear and comparative representation of the most important classification criteria and methods can be found, for example, in the aforecited reference by L. R. Rabiner et al.

A common characteristic of all of these known methods and criteria is that bilateral decisions are always made in the sense that the speech section is invariably and definitively classified according to one or the other possibility depending whether the pertinent criterion or criteria are satisfied. Even though it is possible to achieve a relatively high accuracy with a suitable selection or combination of decision criteria in this manner, actual practice shows that erroneous decisions still occur with a relatively high frequency and that they affect the quality of the synthesized speech to a significant degree. A main cause for this error is that the speech signals in general are of a varying character in spite of all redundance, so that it is simply not possible to establish criteria decision thresholds for making a secure statement in both directions. A certain degree of uncertainty remains and must be accepted.

OBJECT AND BRIEF SUMMARY OF THE INVENTION

In view of this fact, the present invention departs from the principle of bilateral decisions used exclusively heretofore, and instead applies a strategy whereby only unilateral decisions are made, which are absolutely secure in practice. In other words, a speech section is classified unambiguously as voiced or unvoiced only if a certain criterion is satisfied. If, however, the criterion is not satisfied, the speech section is not evaluated definitively as voiced or unvoiced, but evaluated against another classification criterion. Here again, a secure decision in one direction is effected only when the criterion is satisfied, otherwise the decision making procedure continues in a similar manner. This is followed until a safe classification becomes possible. Extensive investigations have shown that, with a suitable selection and sequence of the criteria, usually a maximum of six to seven decision steps are required.

The values of the prevailing decision thresholds determine the degree of safety of the individual decisions. The more extreme these decision thresholds, the more selective are the criteria and more secure the decisions. However, with the increasing selectivity of the individual criteria, the maximum number of necessary decision operations also rises. In actual practice it is readily possible to establish the threshold so that practically absolute (unilateral) decision securities are obtained without increasing the total number of criteria or decision operations over the previously cited measure.

BRIEF DESCRIPTION OF THE DRAWINGS

The invention is explained in greater detail with reference to the drawings attached hereto. In the drawings.

DETAILED DESCRIPTION

Figure 1:
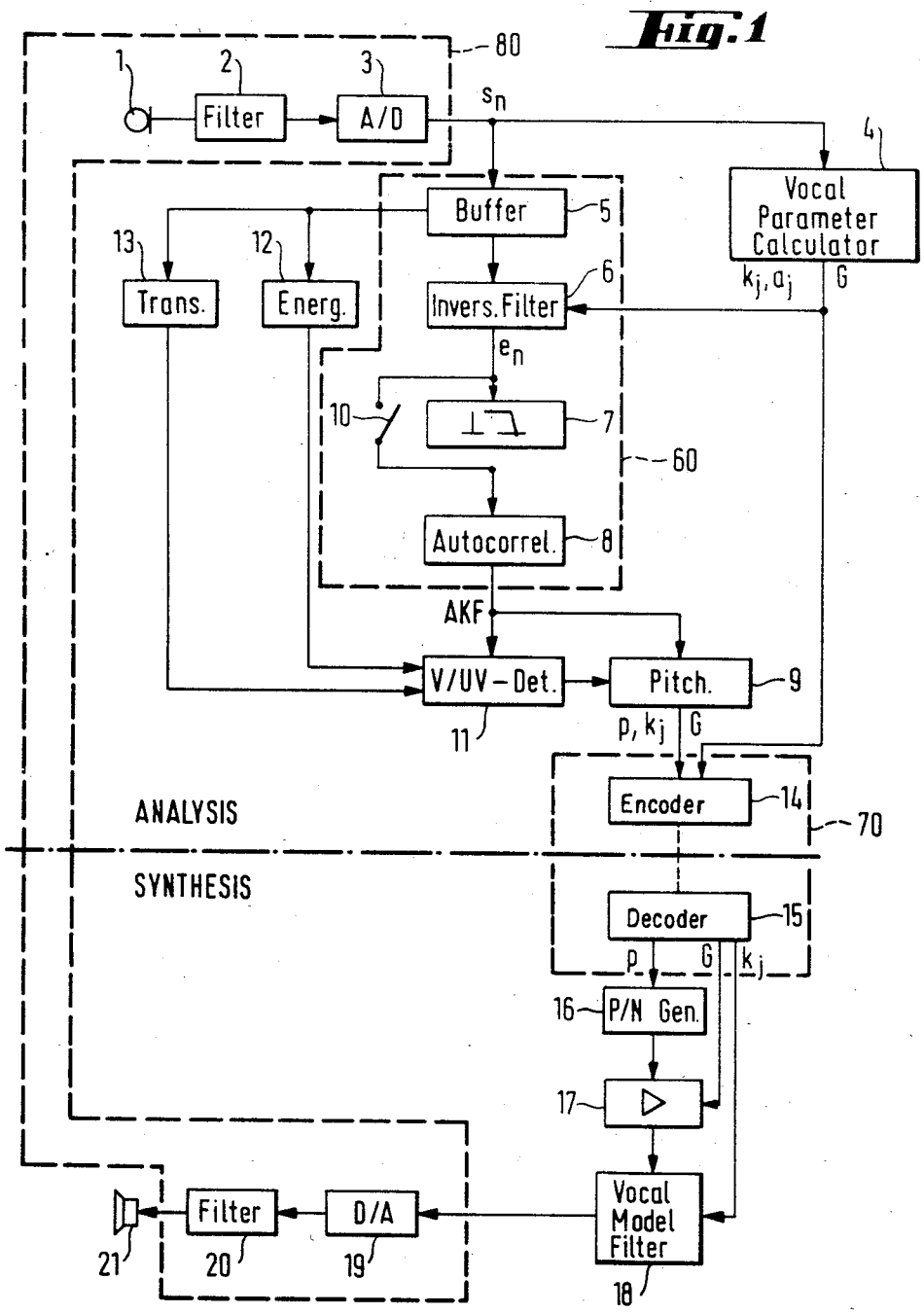
FIG. 1 is a simplified block diagram of a speech synthesizing apparatus implementing the invention.

For analysis, the analog speech signal originating in a source, for example a microphone 1, is band limited in a filter 2 and scanned or sampled in an A/D converter 3 and digitized. The scanning rate can be approximately 6 to 16 KHz and is preferably approximately 8 KHz. The resolution is approximately 8 to 12 bits. The pass band of the filter 2 usually extends, in the so-called wide band speech mode, from approximately 80 Hz to approximately 3.1–3.4 KHz, and in the case of telephone speech from approximately 300 Hz to 3.1–3.4 KHz.

For the subsequent analysis, or the processing to reduce redundance, the digital speech signal $s_n$ is divided into successive, preferably overlapping speech sections, referred to as frames. The length of each speech section may be approximately 10 to 30 msec, and is preferably approximately 20 msec. The frame rate, i.e. the number of frames per second, is approximately 30 to 100, preferably 45 to 70. In the interest of high resolution and thus good quality of speech, sections as short as possible and correspondingly high frame rates are desirable. However this consideration is counterbalanced in real time processing by the limited capacity of the computer that is used and by the requirement of low bit rates in transmission. A process for decreasing the number of required bits, and thereby correspondingly increasing the frame rate, is disclosed in copending, commonly assigned application Ser. No. 421,884 filed Sept. 23, 1982.

An analysis of the speech signal is effected by the principles of linear prediction, as described for example in the aforecited references. The basis of linear prediction is a parametric model of the production of speech. A time discrete all-pole digital filter models the formation of sound by the throat and mouth tract (vocal tract). In the case of voiced sounds, the excitation of this filter is a periodic pulse sequence, the frequency of which, the so-called pitch frequency, idealizes periodic excitation by the vocal cords. In the case of unvoiced sound, the excitation is white noise, idealized for the air turbulence in the throat while the vocal cords are not excited. An amplification factor controls the volume of sound. On the basis of this model, the speech signal is fully determined by the following parameters:

1. The information whether the sound to be synthesized is voiced or unvoiced;
2. The pitch period (or pitch frequency) in the case of voiced sound (with unvoiced sounds the pitch period by definition equals 0);
3. The coefficients of the all-pole digital filter (vocal tract model) that is employed; and
4. The amplification factor.

The analysis is divided essentially into two principal procedures: (1) the computation of the amplification factor or sound volume parameter and the coefficients or filter parameters of the basic vocal tract model filter, and (2) the voiced-unvoiced decision and the determination of the pitch period in the voiced case.

The filter coefficients are obtained in a parameter calculator 4 by solving a system of equations that are established by minimizing the energy of the prediction error, i.e. the energy of the difference between the actual scanned values and the scanning values estimated on the basis of the model assumption in the speech section being considered, as a function of the coefficients. The solution of the system of equations is effected preferably by the autocorrelation method with an algorithm developed by Durbin (see for example L. B. Rabiner and R. W. Schafer, "Digital Processing of Speech Signals", Prentice-Hall, Inc., Englewood Cliffs NJ 1978, pp. 411–413). In the process, so-called reflection coefficients ($k_j$) are obtained in addition to the filter coefficients or parameters ($a_j$). These reflection coefficiehts are transforms of the filter coefficients ($a_j$) and are less sensitive to quantizing. In the case of stable filters the reflection coefficients are always less than 1 in magnitude and they decrease with increasing ordinal numbers. Because of these advantages, the reflection coefficients ($k_j$) are preferably transmitted in place of the filter coefficients ($a_j$). The sound volume parameter G is obtained from the algorithm as a byproduct.

To find the pitch period p (the period of the vocal band base frequency), the digital speech signal $s_n$ is temporarily stored in a buffer 5, until the filter parameters ($a_j$) are calculated. The signal then passes through an inverse filter 6 adjusted to the parameters ($a_j$). This filter possesses a transfer function inverse to the transfer function of the vocal tract model filter. The result of this inverse filtering is a prediction error signal $e_n$, similar to the excitation signal $x_n$ multiplied by the amplification factor G. This prediction error signal $e_n$ is fed in the case of wide band speech, through a low pass filter 7, and into an autocorrelation stage 8. In the case of telephone speech the prediction error signal passes directly to the autocorrelation stage, through a switch 10.

From the error signal the autocorrelation stage forms the autocorrelation function AKF standardized for the autocorrelation maximum of zero order. The autocorrelation function enables the pitch period p to be determined in a pitch extraction stage 9 in a known manner, as the distance of the second autocorrelation maximum RXX from the first maximum (zero order), with an adaptive seeking method preferably being used.

The classification of the speech section being considered as voiced or unvoiced is effected in a decision stage 11 that is supported by an energy determination stage 12 and an zero transition determination stage 13. In the unvoiced case, the pitch parameter p is set equal to zero.

The parameter calculator 4 determines a set of filter parameters per speech section. Naturally, the filter parameters can be determined in a number of manners, for example continuously by means of an adaptive inverse filtering or any other known process, whereby the filter parameters are continuously adjusted with each scanning cycle, and supplied for further processing or transmission only at the times determined by the frame rate. The invention is not restricted in any way in this respect. It is merely necessary that a set of filter parameters be determined for each speech section.

The parameters ($k_j$), G and p are conducted into a encoder 14, where they are converted into a form suitable for transmission.

The recovery or synthesis of the speech signal from the parameters is effected in a known manner with a decoder 15 connected to a pulse noise generator 16, an amplifier 17 and a vocal tract model filter 18. The output signal of the model filter 18 is converted by means of a D/A converter into an analog form and then made audible, after passing through a filter 20, in a reproduction device, for example a loudspeaker 21. The pulse noise generator 16 produces the excitation signal $x_n$ for the vocal tract model filter 18, which is amplified by the amplifier 17. In the unvoiced case this signal consists of white noise ($p=0$) and in the voiced case ($p\neq 0$) it is a periodic pulse sequence of a frequency determined by the pitch period p. The sound volume parameter G controls the amplification factor of the amplifier 17. The filter parameters ($k_j$) define the transfer function of the sound forming or vocal tract model filter 18.

In the foregoing, the general configuration and operation of the speech processing apparatus according to the invention has been explained as being implemented with discrete functional stages for the sake of comprehensibility. It will be apparent to persons skilled in the art, however, that all of the functions or functional stages wherein the digital signals are processed between the A/D converter 3 on the analysis side and the D/A converter 19 on the synthesis side can be implemented in actual practice by means of a suitably programmed computer, microprocessor or the like. With respect to software, the embodiment of the individual functional stages, such as for example the parameter calculator, the different digital filters, autocorrelation, etc. represents a routine task for persons skilled in the art of data processing and has been described in the technical literature (see for example IEEE Digital Signal Processing Committee: Programs for Digital Signal Processing:, IEEE Press Book 1980).

Figure 2:
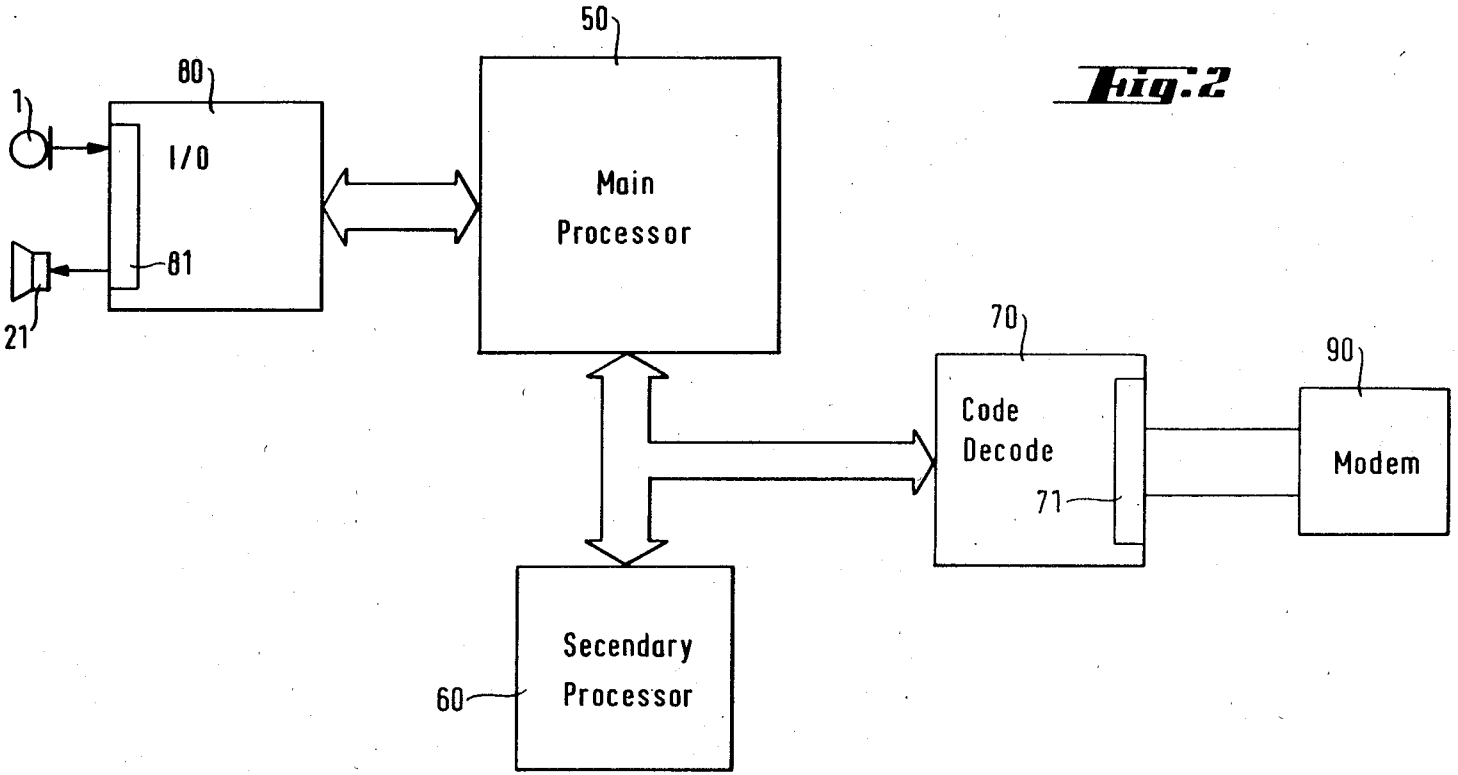
FIG. 2 is a block diagram of a corresponding multiprocessor system.

For real time applications, especially in the case of high scanning rates and short speech sections, extremely high capacity computers are required in view of the large number of operations to be effected in a very short period of time. For such purposes, multiprocessor systems with a suitable division of tasks are advantageously employed. An example of such a system is shown block diagram form in FIG. 2. The multiprocessor system essentially contains four functional units, i.e. a principal processor 50, two secondary processors 60 and 70 and an input/output unit 80. It implements both the analysis and the synthesis.

The input/output unit includes stages 81 for analog signal processing, such as the amplifier, filters and automatic amplification control, together with the A/D converter and the D/A converter.

The principal processor 50 effects the analysis and synthesis of the speech proper, which includes the determination of the filter parameters and of the sound volume parameter (parameter calculator 4), the determination of the energy and zero transitions of the speech signal (stages 12 and 13), the voiced/unvoiced decision (stage 11) and the determination of the pitch period (stage 9). On the synthesis side it produces the output signal (stage 16), its sound volume variation (stage 17) and filtering in the speech model filter (filter 18).

The principal processor 50 is supported by the secondary processor 60, which implements the intermediate storage (buffer 5), inverse filtering (stage 6), possibly low pass filtering (stage 7) and autocorrelation (stage 8).

The secondary processor 70 is concerned exclusively with the coding and decoding of speech parameters and the data traffic with for example a modem 90 or the like, through an interface 71.

Hereinafter, the voiced/unvoiced decision process is explained in greater detail. It should be mentioned initially that the voiced/unvoiced decision and the determination of the pitch period is based preferably on a longer analysis interval than the determination of the filter coefficients. For the latter, the analysis interval is equal to the speech section under consideration, while for the pitch extraction the analysis interval extends on both sides of the speech section into the adjcacent speech sections, for example to about one-half of each. A more reliable and less discontinuous pitch extraction may be effected in this manner. It is to be further noted that when the energy of a signal is mentioned hereinafter, it is intended to signify the relative energy of the signal in the analysis interval standardized on the dynamic volume of the A/D converter 3.

The fundamental principle of the voiced/unvoiced decision according to the invention is, as explained previously, the making of only secure decisions. The word "secure" is defined herein as a decision that has an accuracy of at least 97%, preferably substantially higher and even absolute accuracy, with a correspondingly low statistical error ratio.

Figure 3:
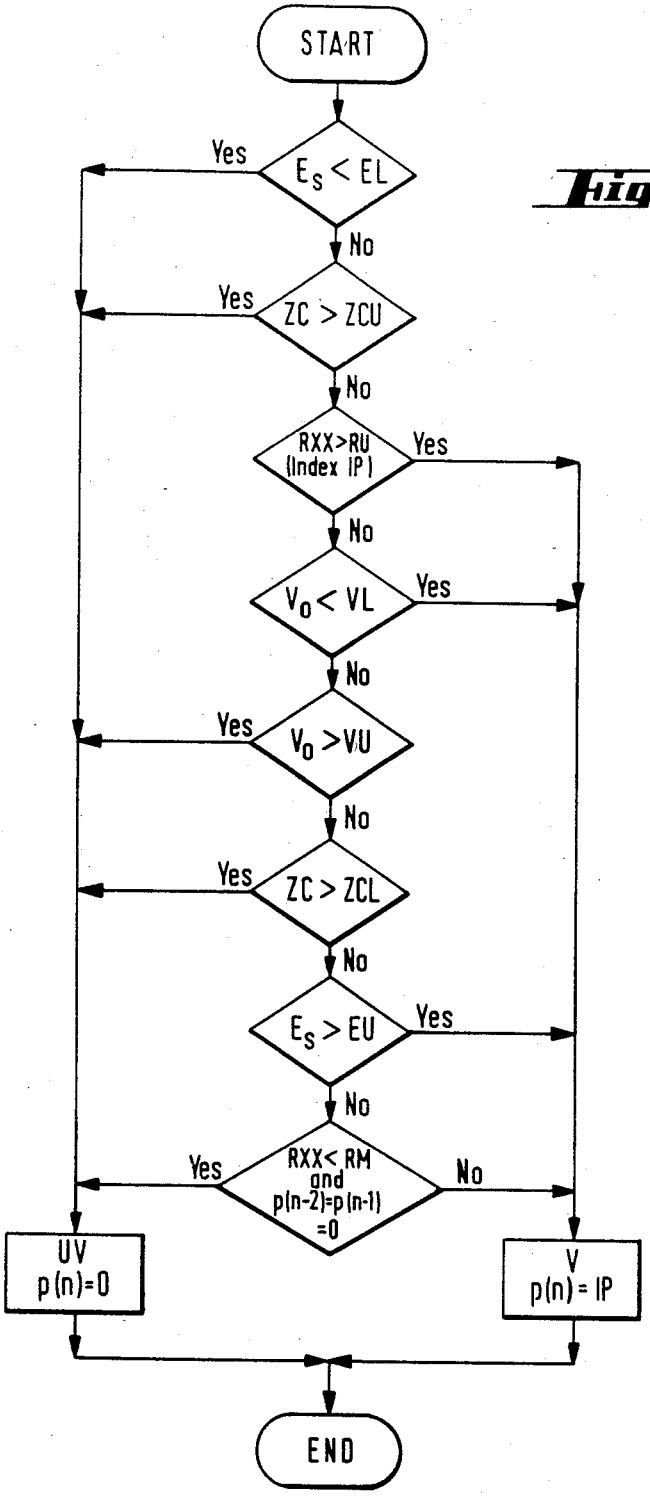
FIGS. 3 and 4 are flow sheets of two different process configurations for the voiced/unvoiced decisions.
Figure 4:
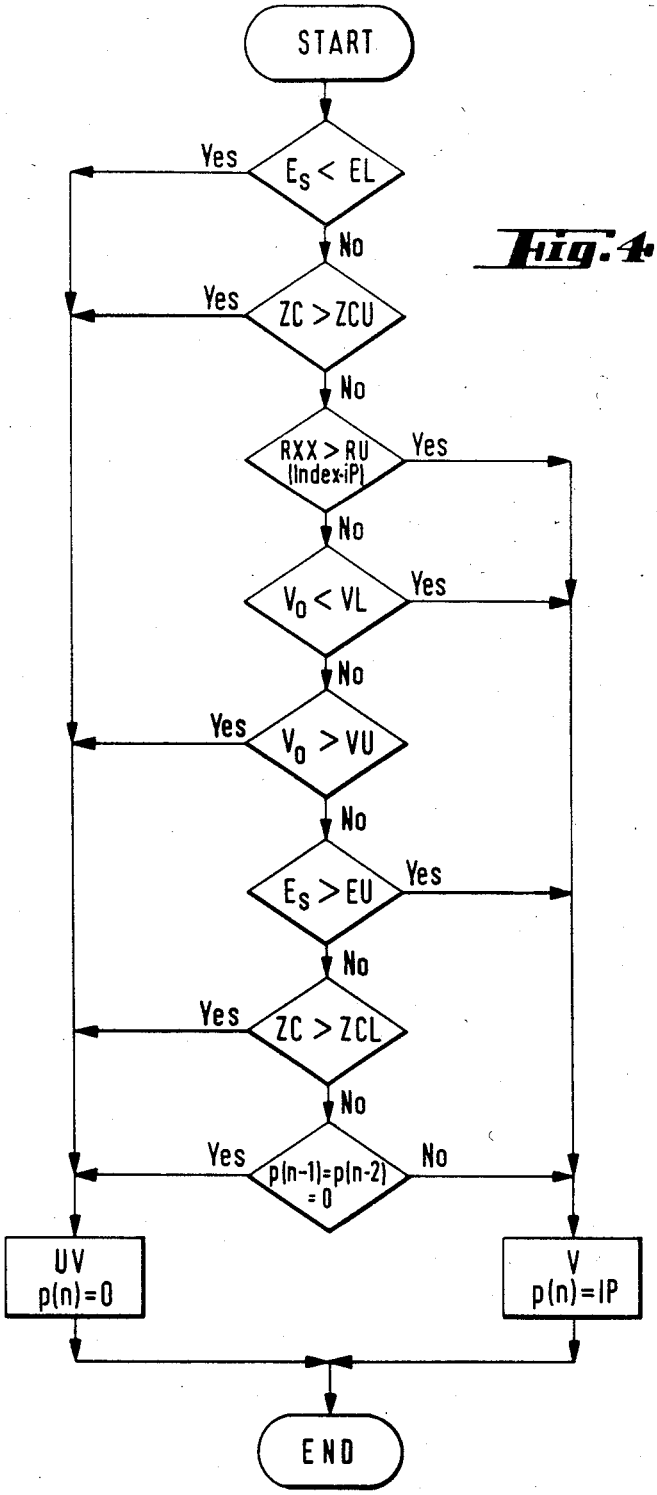

In FIGS. 3 and 4 the flow diagrams of two particularly appropriate decision procedures, embodying the invention, are represented. FIG. 3 represents a variant for wide band speech and FIG. 4 illustrates one for telephone speech.

Referring to FIG. 3, an energy test is effected as the first decision criterion. Here, the (relative, standardized) energy $E_s$ of the speech signal $s_n$ is compared with a minimum energy threshold EL, which is set low enough so that the speech section may be designated safely as unvoiced, if the energy $E_s$ does not exceed this threshold. Practical values of this minimum energy threshold EL are $1.1\times10^{-4}$ to $1.4\times10^{-4}$, preferably approximately $1.2\times10^{-4}$.

These values are valid in the case wherein all digital scanning signals are represented in the unit format ($\pm1$ range). In the case of other signal formats the values must be multiplied by corresponding factors.

If the energy $E_s$ of the speech signal exceeds this threshold, no unambiguous decision can be made and a zero transition test is effected as the next criterion. Herein, the number of zero transitions ZC of the digital speech signal in the analysis interval is determined and compared with a maximum number ZCU. If the number is higher than this maximum number, the speech section is determined unambiguously to be unvoiced, otherwise another decision criterion is employed. For a practically adequate and secure decision the maximum number ZCU amounts to approximately 105 to 120, preferably approximately 110 zero transitions, for an analysis length of 256 scanning values.

The abovementioned sequence of an energy test and zero transition test has performed well in practice. However, it could be reversed, whereupon the decision thresholds should be modified.

As the next decision criterion the standardized autocorrelation function AKF of the low-pass filtered prediction error signal $e_n$ is employed, wherein the standardized autocorrelation maximum RXX, which is located at a distance designated by the index IP from the zero order maximum, is compared with a threshold value RU and evaluated as voiced if this threshold value is exceeded. Otherwise, one proceeds to the next criterion. Favorable values in practice of the threshold value are 0.55 to 0.75, preferably approximately 0.6.

Next, the energy of the low-pass filtered prediction error signal $e_n$, more exactly, the ratio $V_o$ of this signal to the energy $E_s$ of the speech signal, is examined. If this energy ratio $V_o$ is smaller than a first, lower ratio threshold VL, the speech section is evaluated as voiced. Otherwise, a further comparison with a second, higher ratio threshold VU is effected, in which a decision of unvoiced is rendered if the energy ratio $V_o$ exceeds this higher VU threshold. This second comparison may be eliminated under certain conditions.

Suitable values for both ratio threshold values VL and VU are 0.05 to 0.15 and 0.6 to 0.75, preferably approximately 0.1 and 0.7.

If this investigation of the residual error energy does not lead to an unambiguous result, a further zero transition test with a lower decision threshold or maximum number ZCL is effected, wherein a decision of unvoiced is rendered when this maximum number is exceeded. Suitable values of this lower maximum number ZCL are 70 to 90, preferably approximately 80, for 256 scanning values.

In case of doubt, as the next decision criterion a further energy test is effected, wherein the energy $E_s$ of the speech signal is compared with a second higher minimum energy threshold EU and in this case a decision of voiced is rendered if the energy $E_s$ of the speech signal exceeds this threshold EU. Practical values of this minimum energy threshold EU are $1.3\times10^{-3}$ to $1.8\times10^{-3}$, preferably approximately $1.5\times10^{-3}$.

If even then there is no unambiguous decision, first, the autocorrelation maximum RXX is compared with a second, lower threshold value RM. If this threshold value is exceeded, a decision of voiced is rendered. Otherwise, as a last criterion a transverse comparison with one or two immediately preceding speech sections is effected. Here the speech section is evaluated as unvoiced only if the two (or one) preceding speech sections were also unvoiced. Otherwise, a final decision of voiced is rendered. Suitable values of the threshold value RM are 0.35 to 0.45, preferably approximately 0.42.

As mentioned hereinabove, the prediction error signal $e_n$ is low-pass filtered in the case of wide band speech. This low pass filtering effects a splitting of the frequency distribution of the autocorrelation maximum values between unvoiced and voiced speech sections and thereby facilitates the determination of the decision threshold while simultaneously reducing the error frequency. Furthermore, it also makes possible an improved pitch extraction, i.e. determination of the pitch period. An essential condition, however, is that the low pass filtering be effected with an extremely steep flank slope of approximately 150 to 180 db/octave. The digital filter that is used should have an elliptical characteristic, e.g. the limiting frequency should be within a range of 700–1200 Hz, preferably 800 to 900 Hz.

In the case of telephone speech, which compared with wide band speech lacks the frequency range under 300 Hz, low-pass filtering provides no advantages, but is rather disadvantageous. It is therefore omitted in the case of telephone speech. This may be achieved simply by closing the switch 10 or by means of software measures (by not executing pertinent parts of the program).

The decision making process for telephone speech shown in FIG. 4 is in extensive agreement with that for wide band speech. The sequence of the second energy test and the second zero transition test is merely interchanged, although this is not obligatory. Further, the second test of the autocorrelation maximum RXX is omitted, as this would have no results in the case of telephone speech. The individual decision thresholds are different in keeping with the differences of telephone speech with respect to wide band speech. The most favorable values in actual practice are given in the table below:

| Decision Threshold | Range | Typical Value |
|---|---|---|
| EL | $1.4\times10^{-5}$–$1.6\times10^{-5}$ | $1.5\times10^{-5}$ |
| ZCU | 120–140 (for 256 scannings) | 130 |
| RU | 0.2–0.4 | 0.25 |
| VL | 0.05–0.15 | 0.1 |
| VU | 0.5–0.7 | 0.6 |
| EU | $1.3\times10^{-3}$–$1.8\times10^{-3}$ | $1.5\times10^{-3}$ |
| ZCL | 100–200 (for 256 scannings) | 110 |

With the two decision processes described in the foregoing, a voiced/unvoiced decision with extremely low error ratios is obtained. It will be appreciated that the sequence of the criteria and the criteria themselves may be different. In principle, it is merely essential in the case of each criterion that only secure decisions be made.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. In a linear speech processing system wherein a digitized speech signal is divided into sections and each section is analyzed to determine the parameters of the speech model filter, a volume parameter and a pitch parameter, a method for deciding whether the speech signal represents voiced speech or unvoiced speech, said pitch parameter being set equal to zero in the case of unvoiced speech, comprising the steps of:

evaluating the speech signal or a signal derived from the speech signal relative to a first threshold criterion, the threshold value of said criterion being such that satisfaction of the criterion results in a substantially unambiguous decision that the signal represents one of voiced speech or unvoiced speech with the probability of certainty of at least 97%; and evaluating the speech signal or a signal derived from the speech signal relative to a second different threshold criterion when said first criterion is not satisfied, the threshold value of said second criterion being such that satisfaction of the criterion results in a substantially unambiguous decision that the speech represents one of voiced speech or unvoiced speech with a probability of certainty of at least 97%; and evaluating the speech signal or a signal derived from the speech signal relative to a further, different criterion when said second criterion is not satisfied.

2. The method of claim 1, wherein said first criterion is an energy test, with the relative energy of the speech signal being determined and the speech section evaluated as unvoiced if the energy does not exceed a minimum energy threshold.

3. The method of claim 1, wherein said first criterion is a zero transition test, with the number of the zero transitions of the speech signal being decisive and the speech section being evaluated as unvoiced if this number exceeds a maximum number.

4. The method of claim 2, wherein said second criterion is a zero transition test, with the number of the zero transitions of the speech signal being decisive and the speech section being evaluated as unvoiced if this number exceeds a maximum number.

5. The method of claim 1, 2 or 3 wherein said further criterion is a threshold value test of a standardized autocorrelation function, obtained by means of autocorrelation of a prediction error signal formed from the digitized speech signal by means of an inverse filter with a transfer function inverse to the speech model filter, whereby the section is evaluated as voiced if the second maximum of the standardized autocorrelation function exceeds a threshold value.

6. The method of claim 1, 2 or 3 wherein said further criterion is a residual error energy test, wherein a prediction error signal is formed from the digital speech signal by means of an inverse filter with a transfer function inverse to the speech model filter, its energy is determined together with the energy of the speech signal and the ratio of the energy of the prediction error signal to the energy of the speech section is determined and compared with a lower ratio threshold, and the speech section is evaluated as voiced if said ratio is lower than said lower ratio threshold.

7. The method of claim 6, wherein said energy ratio is additionally compared with an upper ratio threshold and the speech section is evaluated as unvoiced if said ratio is larger than the said upper threshold.

8. The method of claim 5, further including a second further decision criterion comprising an energy test, wherein the energy of the speech signal is compared with a second, higher minimum energy threshold and the speech section is evaluated as voiced if the energy exceeds the said higher minimum energy threshold.

9. The method of claim 5, further including an additional further decision criterion comprising a second zero transition test, wherein the number of zero transitions of the speech signal is compared with a second, lower maximum number and the speech section is evaluated as unvoiced of the number exceeds said second maximum number.

10. The method of claim 5, further including an additional further decision criterion comprising a further threshold value test of the standardized autocorrelation function, whereby the section is evaluated as voiced if the second maximum of the standardized autocorrelation function exceeds a second, lower threshold value.

11. The method of claim 1, 2 or 3 wherein said further decision criterion is a transverse comparison with at least two speech sections immediately preceding the speech section under consideration, wherein the speech section is evaluated as unvoiced only if all of the preceding speech sections being compared were also unvoiced.

12. The method of claim 5 wherein said speech signal is passed to an inverse filter to form a prediction error signal and the prediction error signal is low-pass filtered prior to autocorrelation.

13. The method of claim 4, wherein said further cirterion includes a plurality of criteria including a first threshold test of an autocorrelation function, at least one residual error test, a second zero transition test, a second threshold value test of the autocorrelation function, and transverse comparison with preceding speech sections.

14. The method of claim 12 wherein said low pass filtering of the residual prediction error is effected with a limiting frequency in the range of 700 to 1200 Hz.

15. The method of claim 12 wherein said low pass filtering is effected with a steep flanked digital filter having an elliptical characteristic and a flank slope of at least 150 db/octave.

16. The method of claim 5, wherein said standardized autocorrelation function threshold value is in the range of 0.55 to 0.75 with respect to the autocorrelation maximum of zero order.

17. The method of claim 10, wherein said lower threshold value is in the range of 0.35 to 0.45 with respect to the autocorrelation maximum of zero order.

18. The method of claim 2, wherein said minimum energy threshold is in the range of $1.1\times10^{-4}$ to 1.4 to $10^{-4}$.

19. The method of claim 8, wherein said upper minimum energy threshold is in the range of $1.3\times10^{-3}$ to $1.8\times10^{-3}$.

20. The method of claim 3, wherein said maximum number is chosen in the range of 105 to 120 with respect to a speech section length of 256 scanning values.

21. The method of claim 9, wherein said lower maximum number is within a range of 70 to 90 with respect to a speech section length of 256 scanning values.

22. The method of claim 6, wherein said upper ratio threshold is within a range of 0.6 to 0.75.

23. The method of claim 7, wherein said lower ratio threshold is within a range of 0.05 to 0.15.

24. The method of claim 5, wherein said standardized autocorrelation function threshold value is within a range of 0.2 to 0.4, with respect to the autocorrelation maximum of zero order.

25. The method of claim 2, wherein said minimum energy threshold is within a range of $1.4\times10^{-5}$ to $1.6\times10^{-5}$.

26. The method of claim 8, wherein said higher minimum energy threshold is within a range of $1.3\times10^{-3}$ to $1.8\times10^{-3}$.

27. The method of claim 3, wherein said maximum number is chosen within a range of 120 to 140, with respect to a speech section length of 256 scanning values.

28. The method of claim 9, wherein said lower maximum number is within a range of 100 to 120, with respect to a speech section length of 256 scanning values.

29. The method of claim 6, wherein said upper ratio threshold is within a range of 0.5 to 0.7.

30. The method of claim 7, wherein said lower ratio threshold is within a range of 0.05 to 0.15.

31. The method of claim 1 wherein the voiced/unvoiced decision is made with respect to the speech section for which the decision is desired and at least a part of the two speech sections adjacent to the speech section under consideration.

32. Apparatus for analyzing a speech signal using the linear prediction process, comprising:

means for digitizing the speech signal;

a parameter calculator for determining the coefficients of a model speech filter, based upon the energy levels of the digitized speech signal, and a volume parameter for individual sections of the digitized signal;

a pitch decision stage for determining whether the speech information in a section of the signal is voiced or unvoiced, said pitch decision stage including:

means for evaluating the speech signal or a signal derived from the speech signal relative to first criterion having a threshold that, when satisified, results in a substantially unambiguous decision as to one of the voiced and unvoiced conditions, means for evaluating the speech signal or a signal derived from the speech signal relative to second criterion having a threshold that, when satisified, results in a substantially unambiguous decision as to one of the voiced and unvoiced conditions, and means for evaluating the speech signal or a signal derived from the speech signal relative to at least one further criterion when neither of said first and second criteria is satisfied; and a pitch computation stage operative in response to a determination by said pitch decision stage that the signal is voiced for determining the pitch of a voiced speech signal.

33. The apparatus of claim 32 comprising a mutiprocessor system having a principal processor implementing the functions of said parameter calculator, said pitch decision stage and said pitch computation stage, one secondary processor implementing said encoder means, and another secondary processor for temporarily storing a speech signal, inverse filtering the speech signal in accordance with said filter coefficients to produce a prediction error signal, and autocorrelating said error signal to generate an autocorrelation function, said autocorrelation function being used in said principal processor to determine said pitch.

* * * * *